United States Patent [19]

Uadiski

[11] 4,029,212

[45] June 14, 1977

[54] CLOTHES HANGER

[76] Inventor: Ronald Uadiski, Box 17, Seward, Pa. 15954

[22] Filed: Mar. 4, 1976

[21] Appl. No.: 664,053

[52] U.S. Cl. ..... 211/113; 223/DIG. 1

[51] Int. Cl.[2] ..... A47F 7/19

[58] Field of Search ..... 211/113, 13, 193, 189, 211/115, 116, 117, 118, 119, 47, 96, 97, 98; 223/DIG. 1, 92; 248/159

[56] References Cited

UNITED STATES PATENTS

| | | | |
|---|---|---|---|
| 1,691,123 | 11/1928 | Pajeau | 211/113 |
| 2,191,714 | 2/1940 | Gustin | 211/119 |
| 2,429,037 | 10/1947 | Tarnay | 211/96 |
| 2,595,521 | 5/1952 | Hanson | 211/96 X |
| 2,987,193 | 6/1961 | Pajor | 211/96 X |
| 3,088,597 | 5/1963 | Ritchey | 211/119 X |
| 3,214,032 | 10/1965 | Hightower | 223/88 X |
| 3,348,745 | 10/1967 | Basile et al. | 223/92 X |
| 3,565,261 | 2/1971 | Recia | 211/119 |
| 3,860,154 | 1/1975 | Atkins | 211/113 X |
| 3,872,973 | 3/1975 | Duncan | 211/115 |

FOREIGN PATENTS OR APPLICATIONS

| | | | |
|---|---|---|---|
| 239,644 | 10/1911 | Germany | 211/96 |
| 572,132 | 9/1945 | United Kingdom | 223/88 |

*Primary Examiner*—Roy D. Frazier
*Assistant Examiner*—Robert W. Gibson, Jr
*Attorney, Agent, or Firm*—Stanley J. Price, Jr.

[57] ABSTRACT

A clothes hanger that is adapted to support a plurality of pieces of clothing and is so constructed such that each clothing bar has an exposed side and the entire bar is able to rotate 360° about its vertical support.

7 Claims, 2 Drawing Figures

CLOTHES HANGER

BACKGROUND OF THE INVENTION

This invention relates to a clothes hanger; more particularly to a hanger that has clothes support members that are adapted to rotate 360° about the vertical side support therefor and have one exposed distal end to facilitate placing and removing the clothing therefrom.

The prior art teaches a variety of clothes hangers, however they are deficient for one or more reasons, including the fact that they fail to provide for an exposed distal end on the clothes support member; they fail to rotate 360° and the like.

SUMMARY OF THE INVENTION

It is accordingly an object of the instant invention to provide for an improved clothes hanger of the type referred to above.

It is another object to provide for the same at relatively little cost thereby making it generally available.

These and other objects and advantages of the invention will become more apparent from the following detailed disclosure and claim and by reference to the accompanying drawings, in which:

Figure 1:
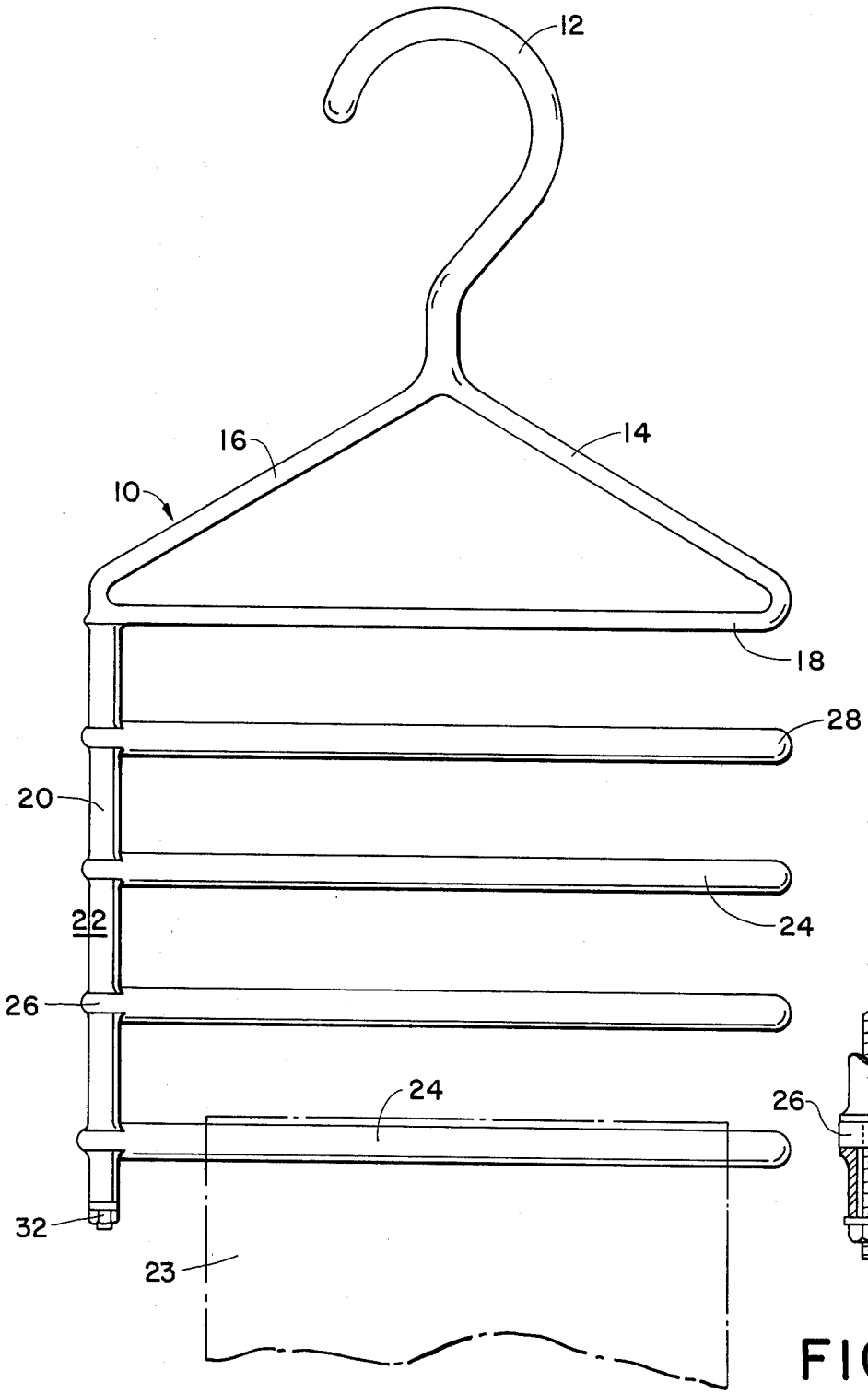
FIG. 1 is a front elevational view.
Figure 2:
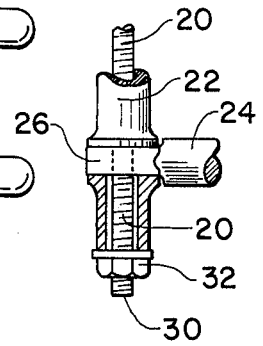
FIG. 2 is a detailed sectional view taken along the line 2 — 2 of FIG. 1.

Broadly speaking the instant invention includes the provision of a clothes hanger adapted to support a plurality of articles of clothing, comprising a body portion having an upwardly extending hook means and depending therefrom a pair of diverging side sections, a base section integral with and engaging the diverging section thereby forming a triangular body, one of the diverging sections having a downwardly extending substantially vertical side support section having a predetermined external diameter, a plurality of hollow cylindrical spacer members having an internal diameter larger than the external diameter of the side support section and adapted to receive the same therethrough, a plurality of horizontally disposed clothing support members, each of the clothing support members terminating at one distal end in a ring member, the ring member having an internal diameter larger than the external diameter of the side support section, the ring member adapted to receive the support section in slidable and rotational engagement whereby the clothing support members are adapted to rotate 360° about the side support member, at least the distal end section of the side support member being externally threaded, internally threaded locking means adapted to engage the distal end section whereby the spacers and support members are retained in position.

DETAILED DISCLOSURE

Referring more particularly to the drawings, there is shown a clothes hanger 10 that is adapted to support a multiplicity of garments thereon. The hanger 10 includes a hook portion 12 that is adapted to engage a suitable member and depend therefrom in the hanging position. The hook portion 12 is integral (preferably unitary) with a pair of converging section 14, 16 and a lower substantially horizontal section 18 that communicates with the diverging section 14, 16 thereby forming a triangle with the hook portion 12 at the apex thereof.

Depending from one of the diverging sections 16 there is a substantially vertically disposed support aim 20 that is preferably externally threaded about its entire length or at least at the distal end thereof. The aim 20 may be affixed to the base of the section 16 by any suitable means such as welding, riviting, adhesive means, etc. or be unitary therewith such as by being threaded subsequent to the molding of the hanger 10. The entire unit may be made of suitable plastic, metal or wood. Disposed about the aim 20 there will be a plurality of hollow cylinders 22 that have an internal diameter that is slightly larger than the external diameter of the aim 20. If desired, the cylinder 22 may be internally threaded to receive in screw fashion, the aim 20, though the same is not necessary, they serve merely as spaces between the horizontal clothes 23 supporting members 24, of which there are several. The length of the cylinder 22 may vary depending upon the desired space between the members 24. Each of the members 24 will be an elongated aim that is preferably circular in cross section and has a hollow ring portion 26 at one distal end thereof and a free distal end 28 at the opposite side. The hollow ring section 26 is aligned such that the diameter thereof is transverse the longitudinal axis of the member 24. The opening in the ring being adapted to slidably receive and engage the member 20 therethrough. The member 24 is thereby adapted to rotate 360° about the support member 20 by turning with the ring 26. The length of the member 20 may vary and as its length is increased additional spacers 22 are needed are as such the hanger 10 will accommodate more support aims 24. If desired, the outer surface of the members 24 may include a clothes frictionally engaging substance i.e., rubber, light adhesive, etc. The distal free end 30 of the member 20 is externally threaded and will accommodate an internally threaded locking nut 32 thereon, thereby maintaining all spacers 22 in position.

As is readily apparent, the aims 24 provide for 360° rotation about the member 20 and have an exposed end 28 to facilitate placing and removing of clothing 23 thereon and therefrom.

Since it is obvious that numerous changes and modifications can be made in the above-described details without departing from the spirit and nature of the invention, it is to be understood that all such changes and modifications are included within the scope of the invention.

I claim:

1. A clothes hanger adapted to support a plurality of articles of clothing, comprising a body portion having an upwardly extending hook means and depending therefrom a pair of diverging side sections, a base section integral with and engaging said side sections thereby forming a triangular body, one of said side sections having a downwardly extending substantially vertical side support section having a predetermined external diameter, a plurality of hollow internally threaded cylindrical spacer members having an internal diameter larger than the external diameter of said side support section and adapted to receive the same therethrough, a plurality of horizontally disposed clothing support members, each of said clothing support members terminating at one distal end in a ring member, said ring member having an internal diameter larger than the external diameter of said side support section, said ring member adapted to receive said support section in slidable and rotational engagement whereby said clothing support members are adapted to rotate 360° about said side support member, at least the distal end section of said side support member being externally threaded, internally threaded locking means adapted to engage said distal end section whereby said spacers and support members are retained in position.

2. The hanger as defined in claim 1 where said spacers and ring members are disposed in alternating arrangement about said side support.

3. The hanger as defined in claim 1 where said side support member is externally threaded substantially about its entire length.

4. The hanger as defined in claim 1 where said side support member is unitary with said diverging section.

5. The hanger as defined in claim 1 wherein said hook portion, converging section and base portion are unitary.

6. The hanger as defined in claim 1 where said clothing support members have a circular cross section.

7. The hanger as defined in claim 1 where said support members include a frictionally engaging outer surface.

* * * * *